United States Patent [19]

Petzold et al.

[11] 4,087,247

[45] May 2, 1978

[54] PROCESS FOR THE DYEING OF POLYACRYLONITRILE FIBERS

[75] Inventors: Manfred Petzold; Heinz Grunert, both of Dusseldorf; Klaus Becker, Monheim, Baumberg, all of Germany

[73] Assignee: Henkel Kommanditgesellschaft auf Aktien, Dusseldorf, Germany

[21] Appl. No.: 750,726

[22] Filed: Dec. 15, 1976

[30] Foreign Application Priority Data

Dec. 15, 1975 Germany ..... 2556377

[51] Int. Cl.[2] ..... D06P 1/66; D06P 3/76; D06P 5/06; C07C 87/30

[52] U.S. Cl. ..... 8/169; 8/177 AB; 8/172 R; 8/84; 8/1 XB; 260/567.6 P

[58] Field of Search ..... 8/169, 177 AB, 172, 8/84; 260/567.6 P

[56] References Cited

U.S. PATENT DOCUMENTS

| | | | |
|---|---|---|---|
| 3,869,250 | 3/1975 | Wegmuller et al. | 8/169 |
| 3,945,794 | 3/1976 | Rokohl et al. | 8/172 R |

FOREIGN PATENT DOCUMENTS

| | | | |
|---|---|---|---|
| 460,969 | 2/1969 | Japan | 8/172 |

*Primary Examiner*—Joseph L. Schofer
*Assistant Examiner*—Maria S. Tungol
*Attorney, Agent, or Firm*—Hammond & Littell

[57] ABSTRACT

Water-soluble quaternary ammonium compounds of the formula:

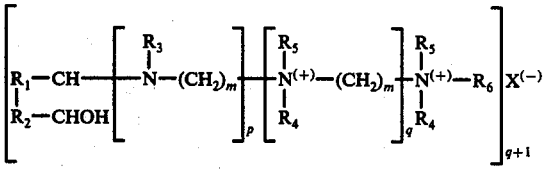

wherein $R_1$ and $R_2$ each represent H or an alkyl radical of $C_1$–$C_{20}$ chain length wherein the sum of the carbon atoms in $R_1$ and $R_2$ is 9 to 20, $R_3$ represents H, an alkyl radical of $C_1$–$C_5$ chain length, a hydroxyalkyl radical of $C_1$–$C_5$ chain length, or a benzyl group, $R_4$ represents an alkyl radical of $C_1$–$C_5$ chain length or a hydroxyalkyl radical of $C_1$–$C_5$ chain length, $R_5$ represents an alkyl radical of $C_1$–$C_5$ chain length, a hydroxyalkyl radical of $C_1$–$C_5$ chain length, or a benzyl group, $R_6$ represents a benzyl group, $m$ represents 2 to 6, $p$ and $q$ represent 0 to 4, wherein $p + q = 1$ to 4, and $X^{(-)}$ represents a salt forming anion, are effective retarding-levelling agents in the dyeing of anionic polyacrylonitrile fibers with basic (i.e., cationic) dyes.

13 Claims, No Drawings

PROCESS FOR THE DYEING OF POLYACRYLONITRILE FIBERS

FIELD OF THE INVENTION

The present invention relates to an improved process for the dyeing of polyacrylonitrile fibrous material by means of basic dyestuffs employing water-soluble quaternary ammonium compounds as retarding and levelling agents.

BACKGROUND OF THE INVENTION

The problems arising during the dyeing of polyacrylonitrile fibers and materials having a content thereof with cationic dyestuffs are known. Owing to their basic character, the cationic dyestuffs have a great affinity for polyacrylonitrile fibers (which are usually anionic), but they attach themselves non-uniformly thereto. This disadvantage becomes apparent particularly when it is desired to dye the fibers with bright tints. The resulting dyeings have a non-uniform or non-level appearance, which renders them unsatisfactory.

In order to obtain more uniform or level dyeings, attempts have been made to decrease the speed of absorption of the dyestuffs by careful temperature control or by addition of retardants, i.e., quaternary ammonium salts which contain higher linear or only slightly branched fatty chains, such as alkylpyridinium salts or fatty alkyltrimethyl- or fatty alkylbenzyldimethylammonium salts. However, the achievement of level dyeings by retardation of the rate or speed of dyeing is extremely time-consuming. Moreover, it is unreliable because the aids used hitherto have only a specific effect and, therefore, have a relatively small range of application.

OBJECTS OF THE INVENTION

An object of the invention is to provide a new method for use in the dyeing of anionic polyacrylonitrile fibers with basic (i.e., cationic) dyes which will provide dyeings of superior levelness without requiring dyers to learn any new technique.

DESCRIPTION OF THE INVENTION

The discovery has now been made that the foregoing object is substantially attained by provision of a dye bath which contains a cationic dye and content of a quaternary ammonium salt of the formula:

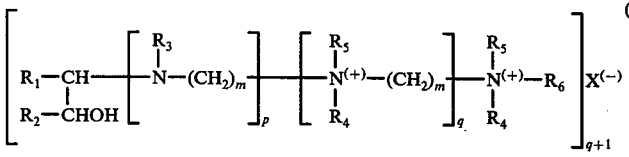

(I)

wherein $R_1$ and $R_2$ each represent H or an alkyl radical of $C_1$–$C_{20}$ chain length wherein the sum of the carbon atoms in $R_1$ and $R_2$ is 9 to 20, $R_3$ represents H, an alkyl radical of $C_1$–$C_5$ chain length, a hydroxyalkyl radical of $C_1$–$C_5$ chain length, or a benzyl group, $R_4$ represents an alkyl radical of $C_1$–$C_5$ chain length or a hydroxyalkyl radical of $C_1$–$C_5$ chain length, $R_5$ represents an alkyl radical of $C_1$–$C_5$ chain length, a hydroxyalkyl radical of $C_1$–$C_5$ chain length, or a benzyl group, $R_6$ represents a benzyl group, $m$ represents 2 to 6, $p$ and $q$ represent 0 to 4, wherein $p + q = 1$ to 4, and $X^{(-)}$ represents a salt forming anion, We have found that these quaternary ammonium compounds act as retardants of the speed of the dyeing and as levellers of the dye absorbed, and that in these ways they produce dyeings of superior tinctorial uniformity.

Accordingly, the present invention provides a process for the dyeing of polyacrylonitrile fibrous material or fibrous material formed from copolymers containing acrylonitrile, which comprises contacting the fibrous material with a dyeing liquor comprising a basic dyestuff and a retarding and levelling agent comprising a water-soluble quaternary ammonium compound of the formula:

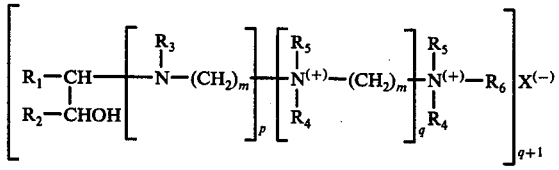

wherein $R_1$ and $R_2$ each represent H or an alkyl radical of $C_1$–$C_{20}$ chain length wherein the sum of the carbon atoms in $R_1$ and $R_2$ is 9 to 20, $R_3$ represents H, an alkyl radical of $C_1$–$C_5$ chain length, a hydroxyalkyl radical of $C_1$–$C_5$ chain length, or a benzyl group, $R_4$ represents an alkyl radical of $C_1$–$C_5$ chain length or a hydroxyalkyl radical of $C_1$–$C_5$ chain length, $R_5$ represents an alkyl radical of $C_1$–$C_5$ chain length, a hydroxyalkyl radical of $C_1$–$C_5$ chain length, or a benzyl group, $R_6$ represents a benzyl group, $m$ represents 2 to 6, $p$ and $q$ represent 0 to 4, wherein $p + q = 1$ to 4, and $X^{(-)}$ represents a salt forming anion, We have further found that the preferred quaternary ammonium salts are those in the total number of carbon atoms in $R_1$ and $R_2$ is 9 to 16, and wherein:

$R_3$ represents hydrogen, methyl or benzyl;

$R_4$ represents methyl;

$R_5$ represents methyl or benzyl;

$R_6$ represents benzyl;

$m$ represents 2 or 3;

$p$ represents 0 or 1;

$q$ represents 1 to 3 inclusive; and $X^-$ represents an anion, such as $Cl^-$ or $CH_3SO_4^-$.

The invention is thus an improvement in the dyeing of a material having a content of an anionic polyacrylonitrile fiber, wherein the material is contacted with an aqueous dye bath containing a cationic dye and said dye is substantively adsorbed by said fiber. The improvement comprises the presence in the bath of a retardant and levelling agent for said dye of an effective amount of a water-soluble quaternary ammonium salt of the formula given above.

The invention further rests on our discovery that the aforesaid dye bath provides dyeings of superior levelness without a significant sacrifice in the speed at which the fiber is dyed.

Accordingly, we have found that aqueous dye baths which comprise an aqueous solution of one or more cationic dyes provide more level dyeings of anionic polyacrylonitrile fibers when they have a dissolved content of one or more of the above-identified quaternary ammonium salts.

The quaternary ammonium salts suitable for use in accordance with the present invention can be prepared by known methods. By way of example, an olefin (wherein the unsaturation is terminal or non-terminal as may be desired) of $C_{11-22}$ chain length is reacted with an epoxidizing agent, such as peracetic acid to form the corresponding olefin epoxide and the olefin epoxide is then reacted with a polyalkylenepolyamine of the formula:

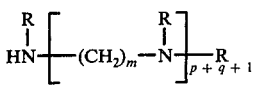

(II)

wherein each R represents $R_3$, $R_4$, $R_5$ and/or $R_6$, as defined in formula I, and $p$ and $q$ are as defined in formula I.

Formation of the quaternary ammonium salts proceeds in conventional manner by quaternization (with preliminary alkylation if amino hydrogen atoms are present) whereby radicals $R_3$, $R_4$, $R_5$ and/or $R_6$ are introduced.

Preferably, the polyalkylenepolyamines used are ethylenediamine, propylenediamine, aminoethylethanolamine, dimethylaminopropylamine, diethylaminopropylamine, diethylenetriamine, triethylenetetramine, tetraethylenepentamine, and bis-(3-aminopropyl)-methylamine. These polyalkylenediamines are water-soluble. Suitable alkylation agents are methyl chloride, methyl bromide, dimethyl sulfate, diethyl sulfate, benzyl chloride and benzyl bromide. The same agents are effective as alkylation agents and can also be used as quaternization agents, as a result of which the alkylation and the quaternization reactions can be effected simultaneously or successively with the same or different agents. Alkylation can also be effected by use of formic acid and formaldehyde according to the Leukart-Wallach reaction.

The quaternary ammonium salts should contain at least one benzyl substituent per molecule.

The quaternary ammonium salts are satisfactorily soluble in water, i.e., they are soluble at least to the extent of 5% therein. They are present in concentrations of from 0.25% to 2% relative to the weight of the fiber at the start of the dyeing, although the quantity used can be varied within wide limits. No trouble is caused by the presence of salts, such as sodium sulfate and sodium chloride, which are customarily present in such dye baths.

A wide variety of cationic dyestuffs are known and numerous members of this class are found in the diphenylmethane and triphenylmethane series. The rhodamine dyes, as well as oxazine, thiazine, diazine, indoline and cyanine dyes and the basic azo and azomethine dyes and the like are generally cationic and are benefited by the invention.

Fibrous materials, the dyeing of which is improved by the present invention, include threads, knitted fabrics, textile fabrics, fleeces, carpeting and the like made from polyacrylonitrile or from copolymers containing polyacrylonitrile. Other natural or synthetic fibrous material can be present. The material can be dyed in the form of tow, combed sliver, flock, continuous filament, yarn, cross-wound bobbin or in some other form intended for further processing to form flat textile articles.

The polyacrylonitrile fibrous materials and fibrous materials formed from copolymers containing acrylonitrile are dyed according to the present invention in conventional manner by use if desired of known dyeing apparatus, such as winch vats, cross-wound bobbin dyeing apparatus, beam dyeing apparatus, hank yarn dyeing apparatus, flock dyeing apparatus, sliver dyeing apparatus, carpet dyeing apparatus, and apparatus for dyeing by the package, drum and paddle system.

The polyacrylonitrile fibers which are benefited by the present invention during dyeing are those which have a content of at least 75% (and preferably 90% to 95% by weight) of (meth)acrylonitrile units. The remaining units of the polymer are typically ester units (for example, methyl or ethyl acrylate or vinyl acrylate), alcohol units (for example, vinyl alcohol units) and acrylic acid or sulfostyrene units which render the polymer immediately substantive to cationic dyes by provision of carboxy and sulfo groups. When the polymer as made contains substantially no acid (i.e., anionic) units (thus when the fiber is composed of homopolymerized acrylonitrile), such units tend to develop during the dyeing operation by hydrolysis of a portion of the nitrile groups which are present. Such fibers are likewise benefited by the present invention. In other instances, non-ionic fibers which carry hydrolyzable ester or amide substituents (fibers containing, e.g., ethyl acrylate, acrylamide, and vinyl benzamide units) are benefited by the process of the present invention because these substituents hydrolyze at least in part during dyeing and thereby provide anionic substituents.

The anionic substituents of polyacrylonitrile fibers need not be uniformly distributed throughout the polymer but can be located on the surface, as they can be provided by subjecting the fiber to short hydrolysis treatment during the fiber-forming operation. The anionic substituents thus provided are generally carboxy substituents.

The aforesaid polyacrylonitrile fibrous materials can be dyed according to the present invention by any of the heretobefore known standard methods. Thus standard apparatus (e.g., winch vats, cross wound bobbin dyeing apparatus, beam dyeing apparatus, hank yarn dyeing apparatus, flock dyeing apparatus, sliver dyeing apparatus, carpet dyeing apparatus, and apparatus for package dyeing, and drum and paddle system apparatus can be used. The apparatus can be adapted for continuous dyeings.

Dye baths according to the present invention are formed by dissolving one or more water-soluble cationic dyes in a body of water together with one or more of the cationic retardant-levelling agents described above. Other agents as are commonly present in the cationic dye baths (wetting agents, fluorescing agents, antibiotics, etc.) can be added if desired. During bath dyeing the weight of the cationic components in the bath decreases. In continuous dyeing processes the concentrations of dyes and supplementary agents in the bath is maintained substantially constant by periodic addition of make-up solution. The baths advantageously have an acidic pH (in the range of 4.0 to 6.5 and are cationic and are used in the temperature range of 40° C. to 106° C.

The dye component is present in the bath in predetermined amount sufficient to provide the desired depth of shade. This varies from instance to instance depending chiefly on the tinctorial power of the dye, the specific color of the dye, and the affinity of the fiber for the dye. In general, the amount is in the range of 0.5 parts to 5000 parts per million parts by weight of bath liquor, or 0.001% to 5.0% on the weight of the fabric to be dyed therein.

The retardant-levelling agent component of the present invention is present in the dyebath in an amount which is effective to cause a significant improvement in the levelness of the dyeing effected. For this purpose the levelling agent component is present in a proportion between about 1:10 and 10:1 based on the weight of the dye component present. In practice we have found that it is better to have too much leveller present rather than too little and, consequently, we prefer the weight of the levelling agent at the start of the dyeing operation to be between one and eight times the weight of the dye (or mixture of dyes). All the agent needed can be added at the start of the dyeing, or the appropriate amount can be added in increments as the dyeing proceeds.

The present invention is further illustrated by the following examples. These examples represent best embodiments of the invention and are not to be construed as limitative thereof.

EXAMPLE 1

The following illustrates the preparation of a dye bath according to the present invention and the dyeing of anionic polyacrylonitrile fibers therein.

(a) A dyeing operation was carried out on an anionically modified polyacrylonitrile yarn using a hank yarn dyeing apparatus and a yarn:liquor weight ratio of 1:25. The dye bath contained (percentages based on the weight of the yarn):

| Component | Percent |
|---|---|
| Astrazon Yellow 7 GLL® | 0.15 |
| Astrazon Red GTL® | 0.10 |
| Astrazon Blue 5 GL® | 0.10 |
| Acetic acid, 30% | 4.0 |
| Adduct of mixed fatty alcohols (chain lengths $C_{12}$–$C_{18}$, Iodine No. 45 to 50) with ethylene oxide (1:35 molar ratio) | 0.2 |
| Retarder-leveller No. 1 (see below) | 1.0 |

The bath was heated from 75° C. to 98° C. in 30 minutes and the hank was dyed for 15 minutes at the latter temperature. The hank was then removed, cooled, and rinsed.

Retarder-leveller No. 1 was prepared as follows:

A mixture of 36.0 gm. of the polyalkylenepolyamine (obtained by reacting an internal $C_{15-18}$ olefin epoxide with N,N-dimethylaminepropylamine), 15 gm. of isopropanol and 30 gm. of water are placed in a flask provided with agitator, reflux condenser and thermometer, and to this are added 12.6 gm. of benzyl chloride at 80° C. The mixture is maintained at that temperature for 20 minutes and is then stirred until all the chlorine becomes present in ionic form. To this are then added 8.5 gm. of sodium bicarbonate and 30 gm. of water, and the mixture is agitated for 15 minutes. An additional 12.6 gm. of benzyl chloride are then added. Agitation is continued until the chlorine therein is also converted to ionic form, after which the solution is neutralized with acetic acid. The product is thus the reaction product of one mol of an internal $C_{15-18}$ olefin epoxide with one mol of N,N-dimethylaminopropylamine quaternized by reaction with one mol of benzyl chloride, followed by neutralization with acid.

After the agitator has been stopped, the reaction product solution divides into two phases, the upper phase of which contains the quaternary ammonium salt (92 gm). This is adjusted to 50% of active substance by adding water, and is a slightly yellow water-soluble liquid.

(b) A dyeing operation was carried out in the same manner with the same bath for the purpose of comparison, except tht the retarder-leveller was replaced with an equal weight of a 50% solution of coconut alkyl dimethyl benzyl ammonium chloride.

Dyeing (a) showed that retarder-leveller No. 1 provided a distinctly stronger retarding action and a more uniform dyeing than the agent employed in dyeing (b).

Retarder-leveller Nos. 2 to 14 shown in the following Table proved to be equally as effective as retarder-leveller No. 1.

EXAMPLE 2

The procedure of Example 1(a) was repeated, except that the retardant-leveller used had the fomula:

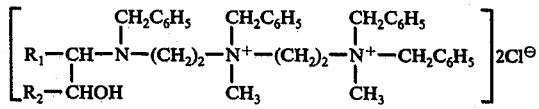

made in the same manner as the retardant-leveller of Example 1(a).

EXAMPLE 3

The following Table presents additional quaternary ammonium retardant-levelling agents which are suitable for use in the process of the present invention. These agents are made in the same manner as the agent of Example 1(a).

TABLE

| No. | No. C Atoms $R_1$ | No. C Atoms $R_2$ | $R_3$ Group | $R_3$ Mol % | $R_4$ | $R_5$ Group | $R_5$ Mol % | $R_6$ | m | p | q | x |
|---|---|---|---|---|---|---|---|---|---|---|---|---|
| 1 | 13–16 | | $-CH_2Ar$ | 100 | $-CH_3$ | $-CH_3$ | 100 | $-CH_2Ar$ | 3 | 1 | — | Cl |
| 2 | 9–12 | | — | — | $-CH_3$ | $-CH_2Ar$ | 100 | " | 3 | — | 1 | Cl |
| 3 | 13–16 | | $-H$ | 100 | $-CH_3$ | $-CH_3$ | 100 | " | 3 | 1 | — | Cl |
| 4 | $-H$ | 14–16 | — | — | $-CH_3$ | $-CH_2Ar$ | 100 | " | 3 | — | 2 | Cl |
| 5 | $-H$ | 12–14 | — | — | $-CH_3$ | $-CH_3$ | 75 | " | 2 | — | 3 | Cl |

TABLE-continued

| No. | No. C Atoms $R_1$ | No. C Atoms $R_2$ | $R_3$ Group | $R_3$ Mol % | $R_4$ | $R_5$ Group | $R_5$ Mol % | $R_6$ | m | p | q | x |
|---|---|---|---|---|---|---|---|---|---|---|---|---|
| | | | | | | $-CH_2Ar$ | 25 | | | | | |
| 6 | 13–16 | | — | — | $-CH_3$ | $-CH_3$ | 50 | " | 3 | — | 1 | Cl |
| | | | | | | $-CH_2Ar$ | 50 | | | | | |
| 7 | 13–16 | | $-H$ | 75 | $-CH_3$ | $-CH_3$ | 100 | " | 3 | 1 | — | Cl |
| | | | $-CH_2Ar$ | 25 | | | | | | | | |
| 8 | $-H$ | 10–12 | $-H$ | 75 | $-C_2H_5$ | $-C_2H_5$ | 100 | " | 3 | 1 | — | Cl |
| | | | $-CH_2Ar$ | 25 | | | | | | | | |
| 9 | 13–16 | | — | — | $-CH_3$ | $-CH_3$ | 80 | " | 3 | — | 1 | Cl |
| | | | | | | $-CH_2Ar$ | 20 | | | | | |
| 10 | $-H$ | 14–16 | $-CH_2Ar$ | 100 | $-C_2H_5$ | $-C_2H_5$ | 100 | " | 3 | 1 | — | Cl |
| 11 | $-H$ | 14–16 | $-H$ | 75 | $-CH_3$ | $-CH_3$ | 100 | " | 3 | 1 | — | Cl |
| | | | $-CH_2Ar$ | 25 | | | | | | | | |
| 12 | 13–16 | | — | — | $-CH_3$ | $-CH_3$ | 100 | " | 3 | — | 1 | $CH_3SO_4$ |
| 13 | $-H$ | 14–16 | $-CH_3$ | 100 | $-CH_3$ | $-CH_2CH_2OH$ | 100 | " | 2 | 1 | — | Cl |
| 14 | 9–12 | | $-H$ | 75 | $-CH_3$ | $-CH_3$ | 100 | " | 3 | 1 | — | Cl |
| | | | $-CH_2Ar$ | 25 | | | | | | | | |

*$-CH_2Ar$ = benzyl

The preceding specific embodiments are illustrative of the practice of the invention. It is to be understood, however, that other expedients known to those skilled in the art, or disclosed herein, may be employed without departing from the spirit of the invention or the scope of the appended claims.

We claim:

1. In the dyeing of a fibrous material having a content of an anionic polyacrylonitrile fiber, wherein said material is contacted with an aqueous dye bath containing a cationic dye and said dye is substantively absorbed by said fiber, the improvement which comprises providing said bath with a content, as retardant for the dyeing and as levelling agent for said dye, of a water-soluble quaternary ammonium salt of the formula:

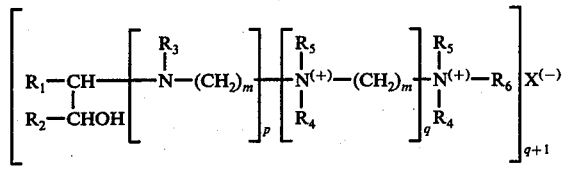

wherein $R_1$ and $R_2$ each represent H or an alkyl radical of $C_1$–$C_{20}$ chain length wherein the sum of the carbon atoms in $R_1$ and $R_2$ is an integer from 9 to 20, $R_3$ represents H, an alkyl radical of $C_1$–$C_5$ chain length, a hydroxyalkyl radical of $C_1$–$C_5$ chain length, or benzyl, $R_4$ represents an alkyl radical of $C_1$–$C_5$ chain length, or a hydroxyalkyl radical of $C_1$–$C_5$ chain length $R_5$ represents an alkyl radical of $C_1$–$C_5$ chain length, a hydroxyalkyl radical of $C_1$–$C_5$ chain length, or benzyl, $R_6$ represents benzyl, $m$ represents an integer from 2 to 6, $p$ and $q$ represent integers from 0 to 4, wherein $p + q$ = an integer from 1 to 4, and $X^{(-)}$ represents a salt forming counter-anion.

2. A process according to claim 1 wherein the retardant-leveller has the formula:

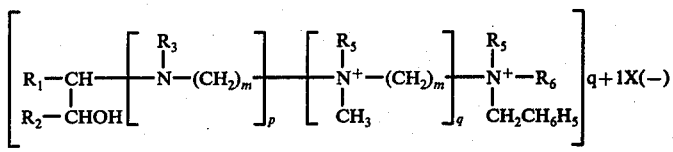

wherein $R_1$ and $R_2$ together represent alkyl groups containing 9 to 16 carbon atoms, $R_3$ represents H, $-CH_3$, or a benzyl group, $R_5$ represents $-CH_3$ or a benzyl group, $R_6$ represents a benzyl group, X represents an anion, $m$ represents the integer 2 or 3, $p$ represents the integer 0 or 1 and $q$ represents an integer from 1 to 3.

3. A process according to claim 1 wherein the retardant leveller has the formula:

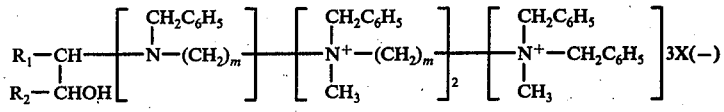

wherein $R_1$ and $R_2$ represent alkyl groups containing 9 to 16 carbon atoms, X represents an anion, and $m$ represents the integer 2 or 3.

4. The process according to claim 1 wherein the retardant-leveller is the reaction product of one mol of an internal $C_{15-18}$ olefin epoxide with one mol of N,N-dimethylaminopropylamine quaternized by reaction with one mol of benzyl chloride.

5. The process according to claim 1 wherein the cationic dye is selected from the group consisting of diphenylmethane, triphenylmethane, rhodamine, oxazine, thiazine, diazine, indoline, cyanine, basic azo and azomethine dyes.

6. The process according to claim 1 wherein said quaternary ammonium salt is present in said bath at the start of said dyeing in amount between 0.25% and 2% of the weight of said fibrous material.

7. The process according to claim 1 wherein the weight ratio of said quaternary ammonium salt to said dye is between 1:10 and 10:1.

8. The process according to claim 1 wherein the weight ratio of said quaternary ammonium salt to said dye is between 1:1 and 8:1.

9. The process according to claim 1 wherein said bath has a pH between 4.0 and 6.5.

10. The process according to claim 1 wherein said fibrous material is in the form of monofilaments, threads, knitted fabrics, woven fabrics, fleeces or carpeting.

11. An aqueous dye bath adapted to dye anionic polyacrylonitrile fibrous material, comprising an aqueous solution of a cationic dye and a quaternary ammonium salt of the formula:

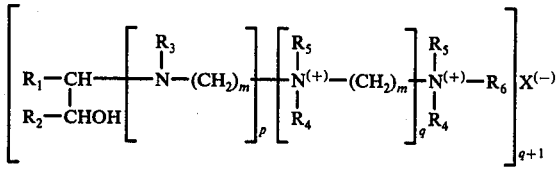

wherein $R_1$ and $R_2$ each represent H or an alkyl radical of $C_1$–$C_{20}$ chain length wherein the sum of the carbon atoms in $R_1$ and $R_2$ is an integer from 9 to 20, $R_3$ represents H, an alkyl radical of $C_1$–$C_5$ chain length, a hydroxyalkyl radical of $C_1$–$C_5$ chain length, or a benzyl group, $R_4$ represents an alkyl radical of $C_1$–$C_5$ chain length or a hydroxyalkyl radical of $C_1$–$C_5$ chain length, $R_5$ represents an alkyl radical of $C_1$–$C_5$ chain length, a hydroxyalkyl radical of $C_1$–$C_5$ chain length, or a benzyl group, $R_6$ represents a benzyl group,

*m* represents an integer from 2 to 6,

*p* and *q* represent integers from 0 to 4, wherein $p + q$ = an integer from 1 to 4, and $X^{(-)}$ represents a salt-forming anion.

12. The bath according to claim 11 wherein the ratio of said dye to said quaternary ammonium salt is between 1:10 and 10:1.

13. The bath according to claim 11 having an acid pH in the range of 4.0 to 6.5.

* * * * *